US008301072B2

(12) United States Patent
Fukunaga et al.

(10) Patent No.: US 8,301,072 B2
(45) Date of Patent: Oct. 30, 2012

(54) GUIDE ROLLER UNIT, GUIDING DEVICE, AND IMAGE FORMING APPARATUS

(75) Inventors: Yasuyuki Fukunaga, Osaka (JP); Hironori Daigo, Osaka (JP)

(73) Assignee: Kyocera Mita Corporation (JP)

( * ) Notice: Subject to any disclaimer, the term of this patent is extended or adjusted under 35 U.S.C. 154(b) by 852 days.

(21) Appl. No.: 12/034,685

(22) Filed: Feb. 21, 2008

(65) Prior Publication Data

US 2008/0205945 A1 Aug. 28, 2008

(30) Foreign Application Priority Data

Feb. 22, 2007 (JP) ..... 2007-041991

(51) Int. Cl.
*G03G 15/00* (2006.01)

(52) U.S. Cl. ..... 399/397; 399/316; 399/162; 399/121

(58) Field of Classification Search ..... 399/316, 399/397, 388, 405, 25, 26, 121; 347/221, 347/222; 271/274
See application file for complete search history.

(56) References Cited

U.S. PATENT DOCUMENTS

| | | | | |
|---|---|---|---|---|
| 6,459,865 | B2 * | 10/2002 | Kusayanagi | 399/101 |
| 6,619,658 | B2 * | 9/2003 | Shiau | 271/274 |
| 7,147,223 | B2 * | 12/2006 | Fukuchi | 271/274 |
| 2009/0147450 | A1 | 6/2009 | Nara et al. | |

FOREIGN PATENT DOCUMENTS

| | | |
|---|---|---|
| JP | 10-198207 | 7/1998 |
| JP | 3093889 | 2/2003 |
| JP | 2006173229 | 6/2006 |

OTHER PUBLICATIONS

Machined translation of JP10-198207.*

* cited by examiner

*Primary Examiner* — Matthew G Marini
(74) *Attorney, Agent, or Firm* — Gerald E. Hespos; Michael J. Porco

(57) ABSTRACT

A guiding roller unit has a holder to be mounted on a mount, and a guiding roller rotatably supported by the holder. The holder includes a base, two bearings and widening preventing plates attached respectively to the bearing. The base, the bearings and the widening preventing parts are integral to each other. The base is mounted on the mount. The bearings stand from opposite ends of the base and rotatably support the roller. The widening preventing plates extend in directions opposite to facing directions of the bearings. The holder enables the roller to be attached and detached with leading ends of the bearings elastically widened with respect to base ends thereof connected with the base while being detached from the mount, whereas it prohibits widening of the leading ends of the bearings by contacting the mount in response to forces acting in widening directions while being mounted on the mount.

20 Claims, 10 Drawing Sheets

GUIDE ROLLER UNIT, GUIDING DEVICE, AND IMAGE FORMING APPARATUS

BACKGROUND OF THE INVENTION

1. Field of the Invention

The present invention relates to a guide roller unit for guiding the conveyance of a sheet, a guiding device and an image forming apparatus provided with the same.

2. Description of the Related Art

An image forming apparatus such as a copier or a printer is provided with a sheet conveyance path for conveying a sheet to which an image is transferred. A guide roller unit for guiding the conveyance of a sheet is arranged in such a sheet conveyance path. A known guide roller unit has a simple construction in which a guide roller is rotatably supported by a holder formed by bending a steel plate.

Japanese Unexamined Patent Publication No. H10-198207 (D1) discloses a guide roller unit comprising a holder including a base part and a pair of bearing parts opposed to each other is formed by bending a steel plate having spring elasticity into U-shape, and a guide roller rotatably supported by the pair of bearing parts. Upon mounting the guide roller on the bearing parts, the leading end of the bearing parts are elastically widened apart and the opposite ends of a rotary shaft of the guide roller are fitted into through holes formed in the respective bearing parts from the inside. Thereafter, the bearing parts are restored to sandwich the guide roller by the bearing parts from the opposite sides, whereby the guide roller is rotatably supported. The guide roller unit assembled in this way is mounted on a mount surface of a specified mounting member. The guide roller unit disclosed in D1 publication has advantages of having a simple construction and being quite easy to assemble the guide roller into the holder.

However, the advantage of being easy to assemble the guide roller into the holder leads to a disadvantage that the guide roller is likely to come off after the assembling. How to solve this disadvantage is not particularly mentioned in D1 publication.

SUMMARY OF THE INVENTION

An object of the present invention is to enable a guide roller to be easily assembled into a holder in a guide roller unit for guiding a sheet being conveyed, and can reliably prevent the guide roller from coming off the holder after the holder is mounted on a specified mount portion.

Another object of the present invention is to provide a guiding device and an image forming apparatus including the guide roller unit.

In order to accomplish the above object, according to an aspect of the present invention, a guiding roller unit comprises a holder to be mounted on a specified mount portion; and a guiding roller including a rotary shaft and rotatably supported by the holder, the holder including a base part to be mounted on the mount portion, a pair of bearing parts standing from one end and the other end of the base part to face each other and engaged with the opposite ends of the rotary shaft of the guiding roller from outsides to rotatably support the guide roller, and widening preventing parts attached to the pair of bearing parts in such a manner as to extend in directions opposite to facing directions of the respective bearing parts, the base part, the bearing parts and the widening preventing parts being integral to each other. The guide roller is able to be attached and detached while leading ends of the bearing parts are elastically widened with respect to base ends of the bearing parts connected with the base part while the holder is detached from the mount portion, and the widening of the leading ends of the bearing parts being prohibited by coming into contact with the mount portion in response to forces acting in widening directions while the holder is mounted on the mount portion.

According to another aspect of the present invention, a sheet guiding device comprises a guide main body having a guiding surface for guiding a sheet; and a guiding roller unit mounted on the guiding surface, wherein the guiding roller unit has the construction of the above guiding roller unit.

Still another aspect of the present invention is directed to an image forming apparatus comprising a sheet storing section for storing sheets; an image forming assembly for forming an image on a sheet; a sheet conveyance path for conveying the sheet via the image forming assembly; and a guiding roller unit arranged in the sheet conveyance path downstream of the image forming assembly for guiding the sheet, wherein the guiding roller unit has the construction of the above guiding roller unit.

These and other objects, features, aspects and advantages of the present invention will become more apparent upon a reading of the following detailed description and accompanying drawings.

DETAILED DESCRIPTION OF THE PREFERRED EMBODIMENTS

Figure 1:
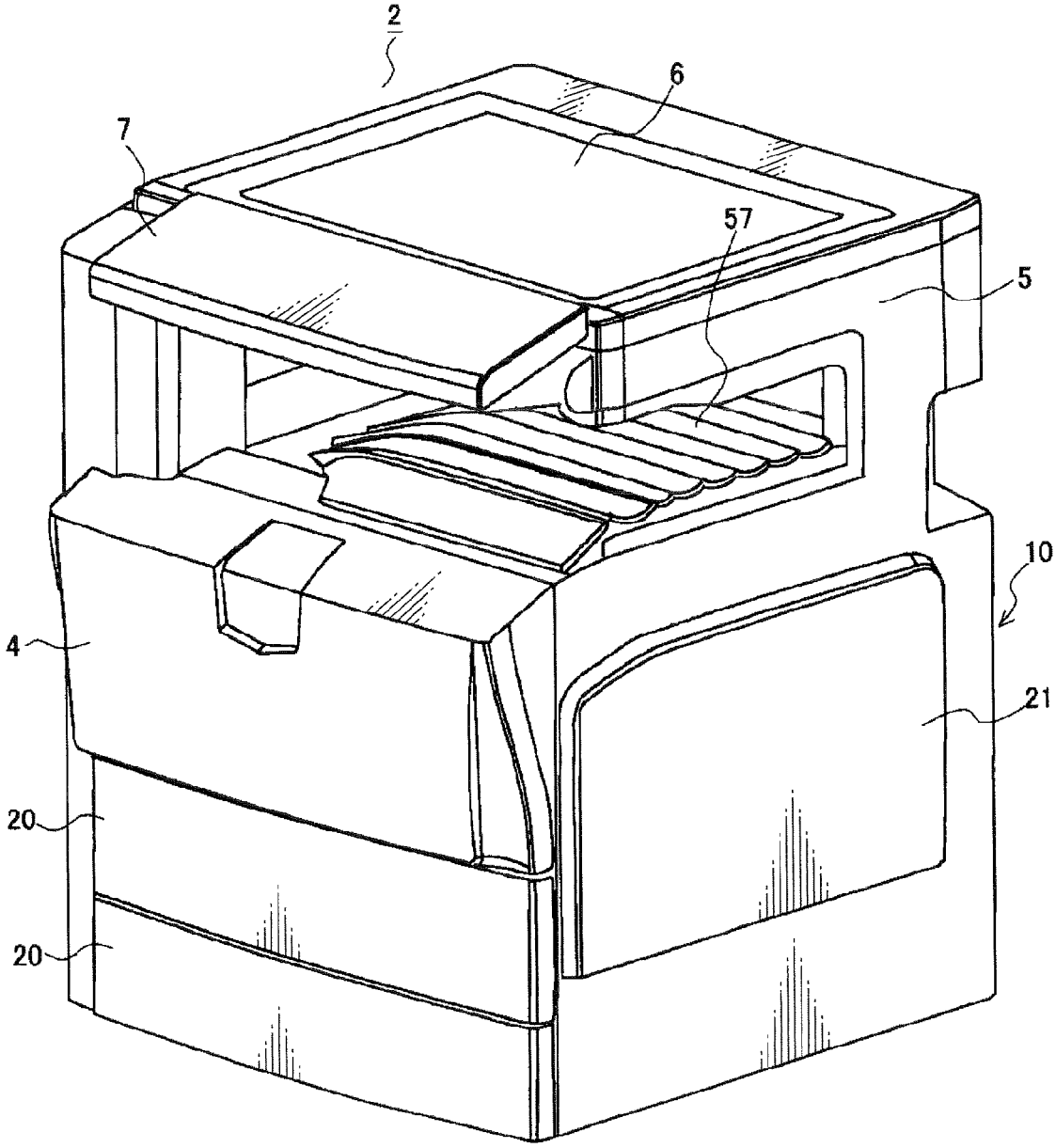
FIG. 1 is a perspective view of an image forming apparatus using a guide roller unit according to an embodiment of the invention, obliquely viewed from a front right upper.

Hereinafter, a best embodiment of the present invention is described in detail with reference to the accompanying drawings. It should be noted that members and the like identified by the same reference numerals in the respective drawings have the same constructions and that repeated description on them is suitably omitted. Further, the diagrammatic representation of members and the like unnecessary for the description is suitably omitted.

With reference to FIGS. 1 to 9, a guide roller unit 1 and an image forming apparatus 2 provided with the guide roller unit 1 according to the embodiment of the present invention are described. FIG. 1 is a perspective view of the image forming apparatus 2 according to this embodiment when obliquely viewed from a front right upper. The front faces an operator stands at the time of using the image forming apparatus 2. The image forming apparatus 2 corresponds to a copier, a printer, a facsimile machine or a complex machine of these. Although any desired method such as an electrophotographic method, an ink-jet method or a thermal transfer method can be adopted as an image forming method, the electrophotographic image forming apparatus 2 is described as an example in this embodiment.

Figure 2:
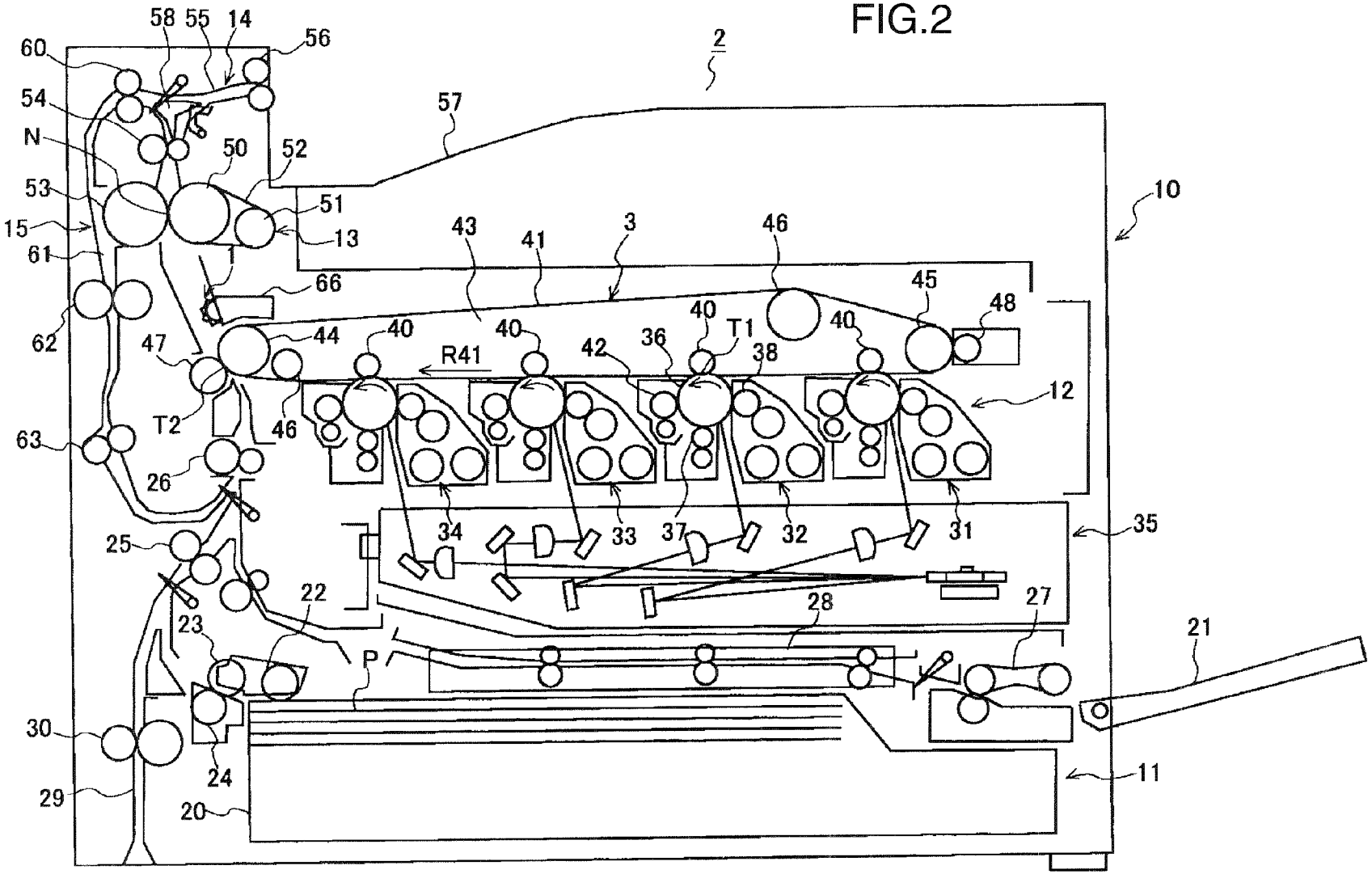
FIG. 2 is a front view in section schematically showing an internal construction of the image forming apparatus.
Figure 3:
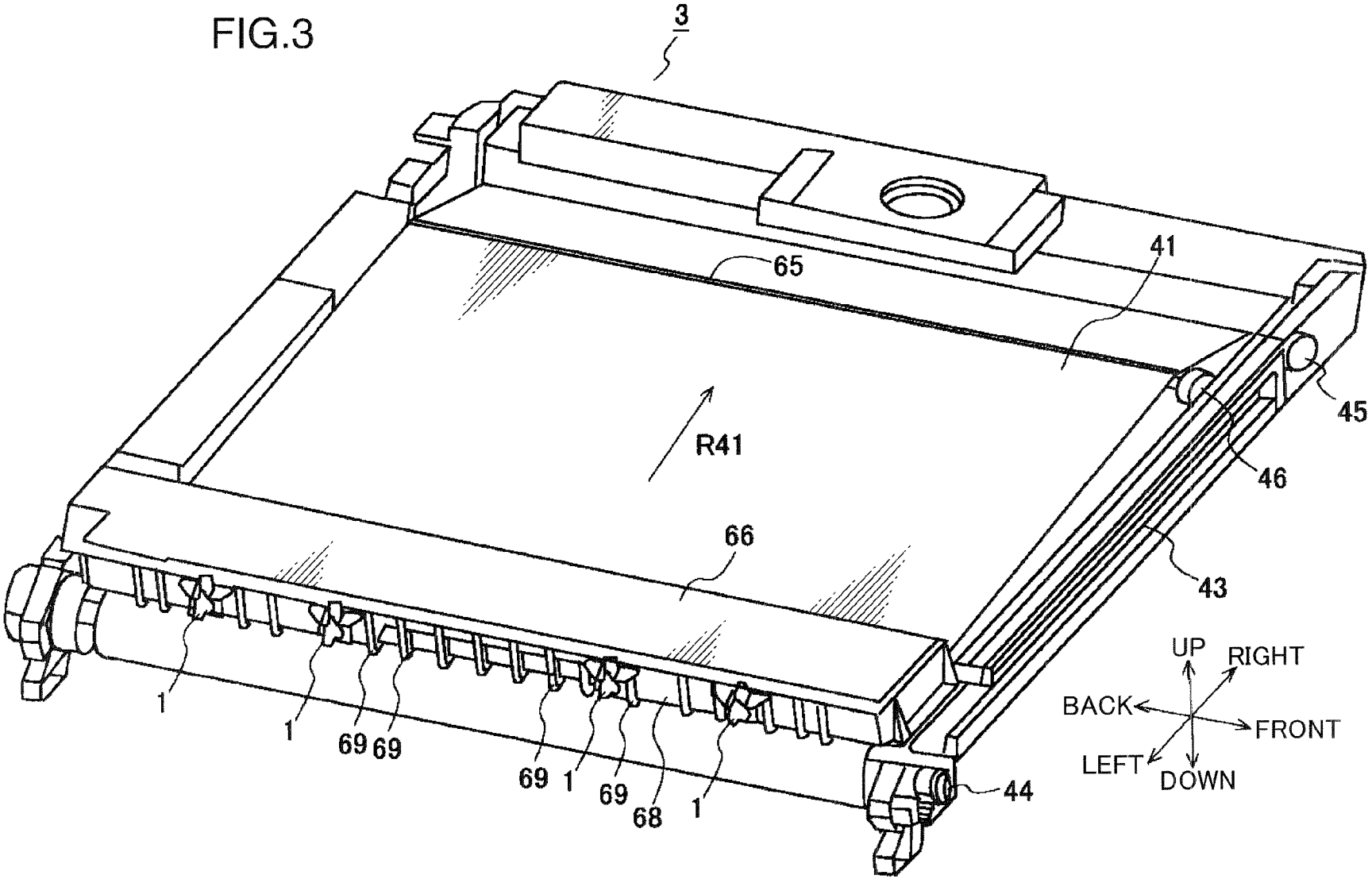
FIG. 3 is a perspective view of an intermediate transfer belt unit having the guide roller units mounted thereon, obliquely viewed from a left upper.
Figure 4:
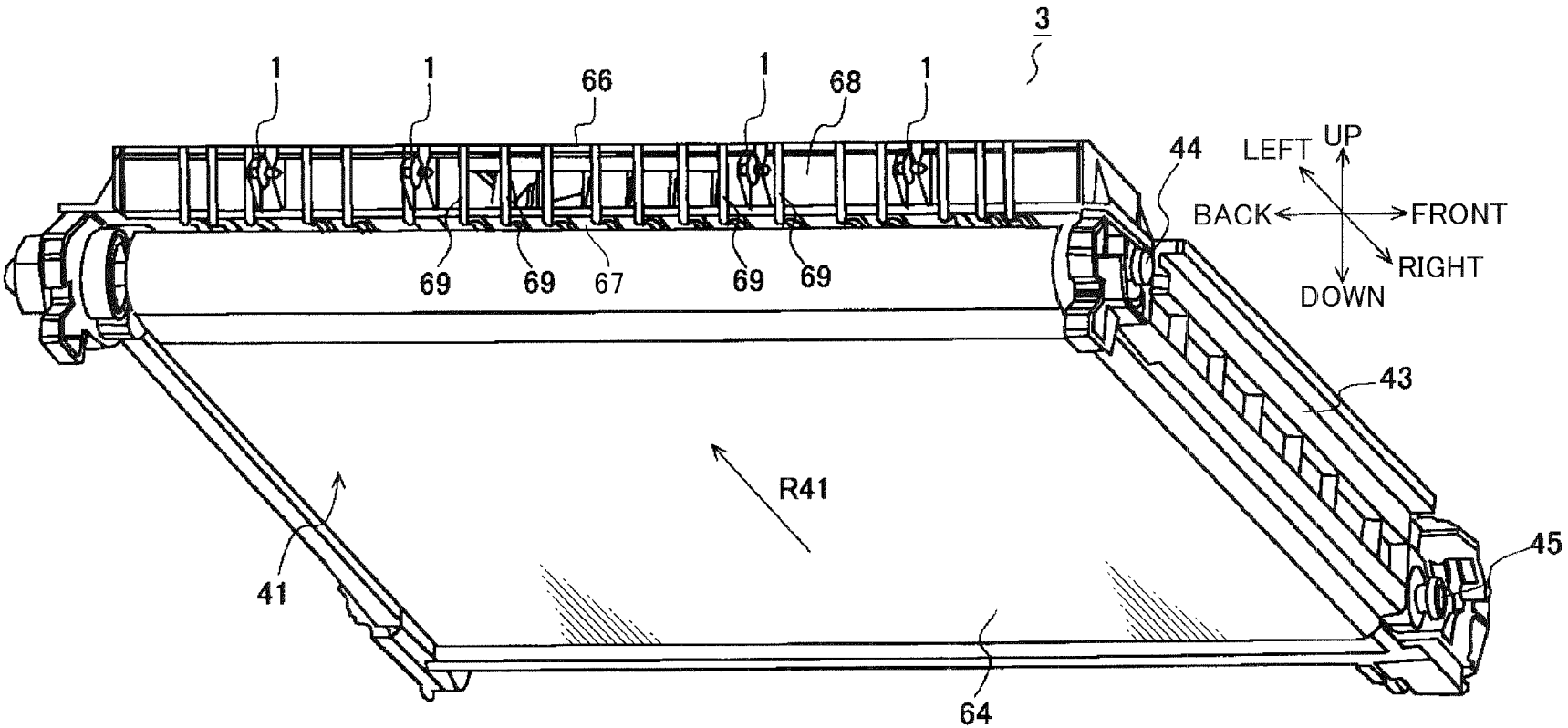
FIG. 4 is a perspective view of the intermediate transfer belt unit, obliquely viewed from a left lower.
Figure 5:
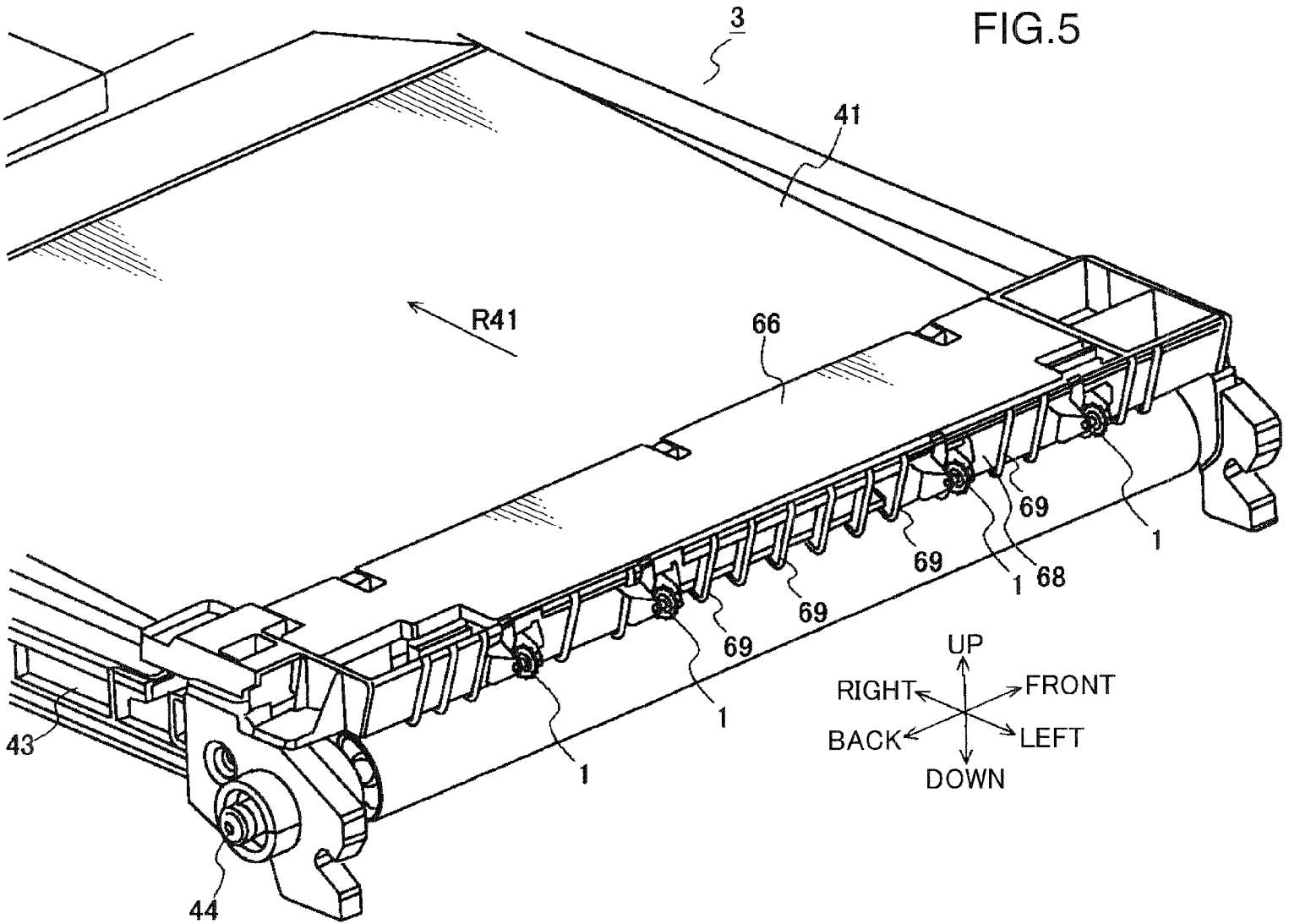
FIG. 5 is a perspective view enlargedly showing a left part of the intermediate transfer belt unit.
Figure 6:
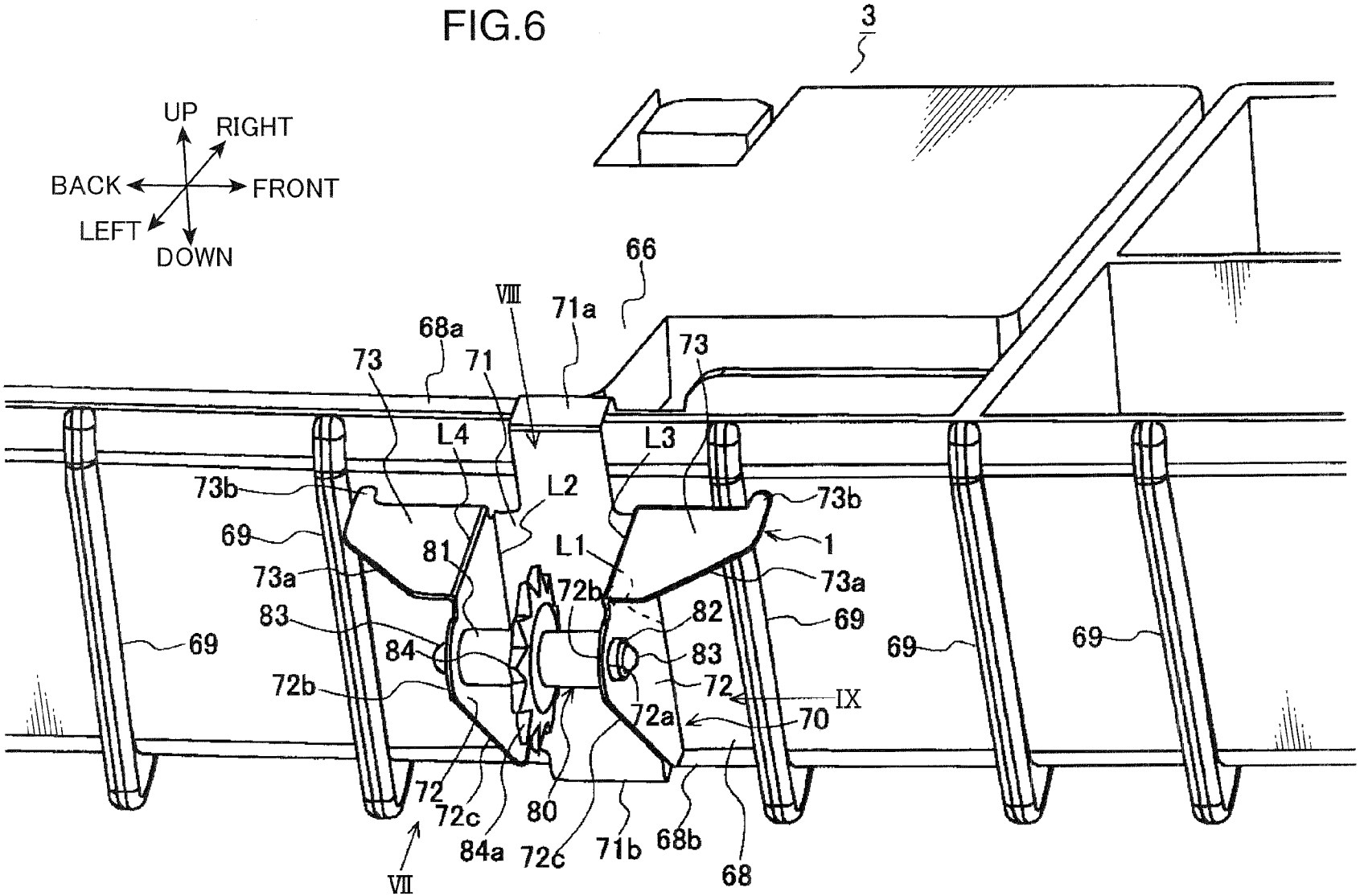
FIG. 6 is a perspective view enlargedly showing the guide roller unit in a mounted state.
Figure 7:
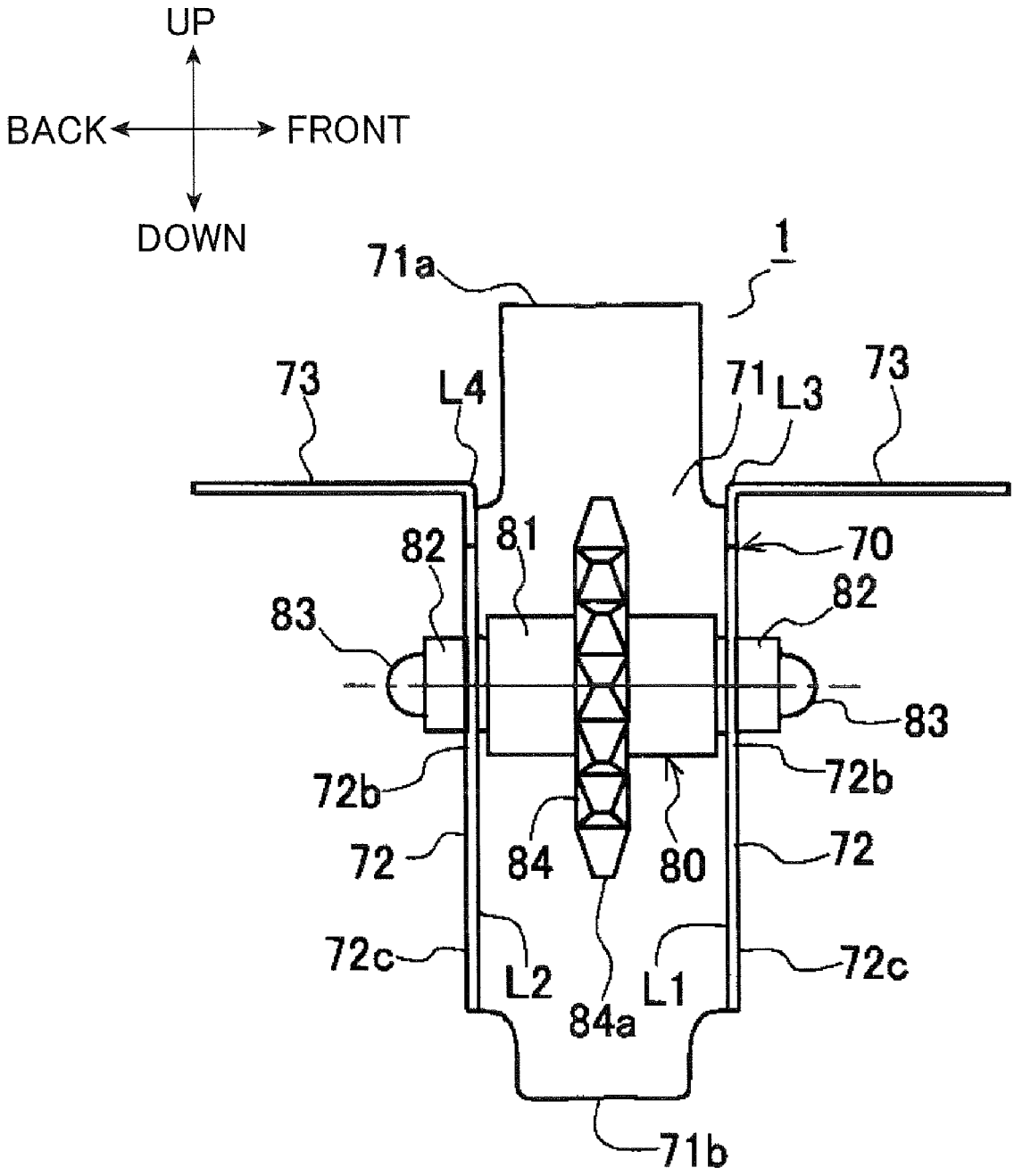
FIGS. 7, 8 and 9 are plan views when viewed in a direction of arrow VII, a direction of arrow VIII and a direction of arrow IX of FIG. 6.
Figure 8:
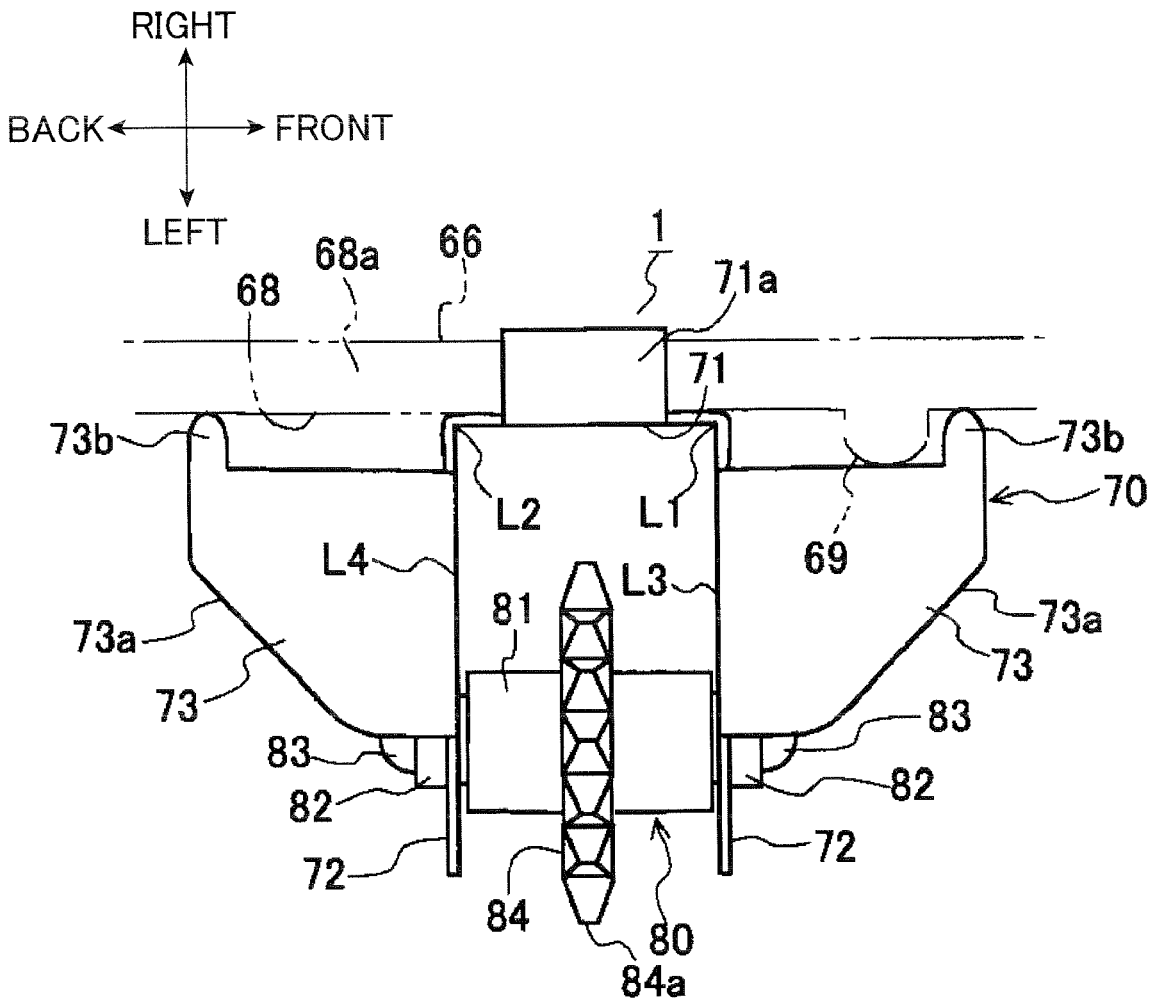
Figure 9:
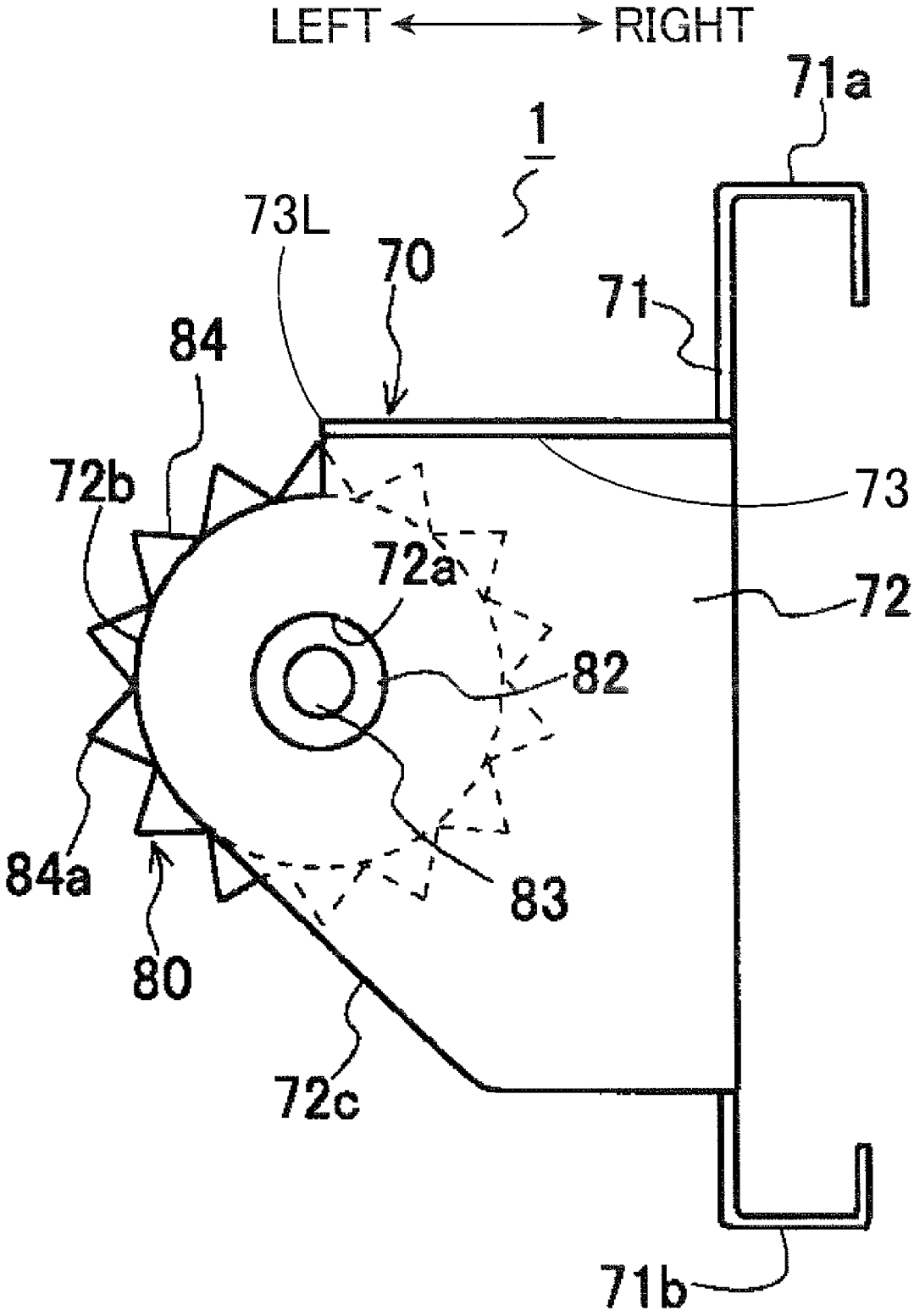

FIG. 2 is a front view in section schematically showing the internal construction of the image forming apparatus 2; FIGS. 3 and 4 are perspective views of an intermediate transfer belt unit 3 having the guide roller units 1 mounted thereon when obliquely viewed from a left upper and when obliquely viewed from a left lower; FIG. 5 is a perspective view enlargedly showing a left part of the intermediate transfer belt unit 3; and FIG. 6 is a perspective view enlargedly showing the guide roller unit 1 in a mounted state. FIGS. 7, 8 and 9 are plan views when viewed in a direction of arrow VII, a direction of arrow VIII and a direction of arrow IX in FIG. 6.

Hereinafter, the image forming apparatus 2, the intermediate transfer belt unit 3 and the guide roller unit 1 are successively described.

(Overall Description of the Image Forming Apparatus)

With reference to FIGS. 1 and 2, the image forming apparatus 2 is summarily described. The image forming apparatus 2 is provided with an image forming apparatus main body 10. A sheet cassette 20 that can be pulled out forward and a door 4 openable forward are provided at the front side of the image forming apparatus main body 10, and an openable and closable manual feed tray 21 is arranged on the right surface thereof. A discharge tray 57 is provided on the upper of the image forming apparatus main body 10, and an image reader 5 is arranged above the discharge tray 57 while defining a space therebetween.

A contact glass 6, on which a document (not shown) to have an image read therefrom is to be placed, is arranged on the upper surface of the image reader 5. An operation panel 7 is arranged before the contact glass 6. In FIG. 1, an openable and closable document pressing plate is not shown. The intermediate transfer belt unit 3 (see FIG. 2) to be described later is attached to and detached from a specified position in the image forming apparatus main body 10 with the door 4 on the front opened.

As shown in FIG. 2, a sheet feeder 11, an image forming assembly 12, a fixing device 13, a sheet discharging device 14 and a sheet refeeder 15 are provided in the image forming apparatus main body 10.

The sheet feeder 11 is for feeding a sheet P to the image forming assembly 12 and includes the sheet cassette 20 for storing sheets P, the manual feed tray 21 used for the manual feed of sheets, and a large-volume deck (not shown) arranged below the image forming apparatus 10.

In the case of a sheet feed from the sheet cassette 20, the sheets accommodated in a stacked state in the sheet cassette 20 are fed by a feed roller 22 and one of them is separated by a feed roller 23 and a retard roller 24 to be conveyed to a pair of registration rollers 26 by a pair of conveyance rollers 25. In the case of a sheet feed from the manual feed tray 21, a sheet set on the manual feed tray 21 is fed by a manual feeding unit 27 and conveyed to the pair of registration rollers 26 by a manual conveying unit 28. In the case of a sheet feed from the large-volume deck, a sheet P fed from the large-volume deck is conveyed to the pair of registration rollers 26 along a conveyance path 29 extending upward at the left end of the image forming apparatus main body 2 by a pair of conveyance rollers 30.

The sheet P fed from each of these sheet cassette 20, manual feed tray 21 and large-volume deck is fed to the image forming assembly 12 in synchronism with a toner image conveyed by an intermediate transfer belt 41 of the image forming assembly 12 to be described later after the oblique conveyance thereof is temporarily corrected by the pair of registration rollers 26.

The image forming assembly 12 includes four image forming units, i.e. yellow (Y), magenta (M), cyan (C) and black (K) image forming units 31, 32, 33 and 34, an exposure device 35 and the intermediate transfer belt unit 3. Since the constructions of the respective image forming units 31 to 34 are similar, only the magenta image forming unit 32 is described with parts thereof identified by reference numerals and the other image forming units 31, 33 and 34 are not described.

The image forming unit 32 includes a photoconductive drum 36, a charger 37, a developing device 38, a primary transfer roller 40 and a cleaner 42, the parts 37 to 42 being arranged around the photoconductive drum 36. The exposure device 35 is arranged below the image forming unit 32.

The photoconductive drum 36 is rotatable about its central axis and has an electrostatic latent image and a toner image formed on the circumferential surface thereof while being rotated. The charger 37 uniformly charges the circumferential surface of the photoconductive drum 36. The exposure device 35 irradiates the uniformly charged circumferential surface of the photoconductive drum 36 with a beam based on image information to form an electrostatic latent image. The developing device 38 supplies toner to the electrostatic latent image formed on the circumferential surface of the photoconductive drum 36 to form a toner image. The primary transfer roller 40 is opposed to the photoconductive drum 36 with the intermediate transfer belt 41 of the intermediate transfer belt unit 3 held therebetween for transferring the toner image to the intermediate transfer belt 41. The cleaner 42 cleans the circumferential surface of the photoconductive drum 36 by removing the toner residual on this circumferential surface after the primary image transfer of the toner image.

The intermediate transfer belt unit 3 is provided with a frame 43, rollers supported in the frame 43 including a drive roller 44, a driven roller 45, a tension roller 46 and the primary transfer roller 40, and the endless intermediate transfer belt 41 mounted on these rollers.

The intermediate transfer belt 41 turns in a direction of arrow R41 by the rotation of the drive roller 44. Toner images of the respective colors formed on the above-described photoconductive drums 36 are successively transferred to the intermediate transfer belt 41 in primary transfer locations T1 by the primary transfer rollers 40. The toner images of the four colors (Y, M, C, K) superimposed on the intermediate transfer belt 41 in this way are collectively transferred to a sheet P fed from the above sheet feeder 11 by a secondary transfer roller 47 at a secondary transfer nip portion T2. On the other hand, the toner residual on the surface of the intermediate transfer belt 41 after the toner image transfer is removed by a belt cleaner 48. Out of the intermediate transfer belt unit 3, a part relating to the guide roller unit 1 according to the embodiment of the present invention is described in detail later.

The fixing device 13 includes a fixing roller 50, a heating roller 51, a fixing belt 52 mounted on these rollers 50, 51 and a pressure roller 53. A fixing nip portion N is formed between the fixing belt 52 and the pressure roller 53, and the sheet P having the toner image transferred to the surface thereof in the above image forming assembly 12 has the toner image fixed to the surface thereof by heat and pressure upon passing this fixing nip portion N.

The sheet discharging device 14 includes a pair of conveyance rollers 54, a discharge path 55 and a pair of discharge rollers 56. The sheet P having the toner image fixed thereto is conveyed along the discharge path 55 by the pair of conveyance rollers 54 and discharged onto the discharge tray 57 by the pair of discharge rollers 56.

The sheet feeder 15 is a sheet conveyance path used upon printing both sides of the sheet P, and includes a flapper 58, a reconveyance path 61 and pairs of reconveyance rollers 62, 63. In the case where an instruction for duplex printing is given, the sheet P having the toner image fixed to the top surface thereof is conveyed to the above discharge path 55 and further conveyed until the trailing end of the sheet P passes the flapper 58. Immediately thereafter, a sheet guiding direction of the flapper 58 is switched and rotating directions of the pair of discharge rollers 56 are reversed, whereby the sheet P is turned upside down and introduced to the reconveyance path 61 by a pair of conveyance rollers 60. Thereafter, the sheet P is conveyed by the pairs of reconveyance rollers 62, 63 and is fed to the image forming assembly 12 again. The sheet P fed to the image forming assembly 12 has a toner image transferred again to the underside thereof, has it fixed in the fixing device 13 and is discharged onto the discharge tray 57 via the discharge path 55.

(Intermediate Transfer Belt Unit)

The intermediate transfer belt unit 3 includes the frame 43; the drive roller 44, the driven roller 45, the tension roller 46 supported in the frame 43; and the intermediate transfer belt 41 mounted on these rollers.

A part of the mounted intermediate transfer belt 41 located at the lower side, i.e. located downstream of the driven roller 45 and upstream of the drive roller 44 in the turning direction (direction of arrow R41) as shown in FIG. 4 serves as a toner image bearing surface 64 for bearing toner images transferred from the above photoconductive drums of the respective colors. On the other hand, as shown in FIG. 3, a part of the intermediate transfer belt 41 located at the upper side, i.e. downstream of the drive roller 44 and upstream of the driven roller 45 in the turning direction (direction of arrow R41) is biased from the inner side to the outside by the tension roller 46 and has a mountain-shape having a peak 65 located at this biased portion.

As shown in FIGS. 3 to 5, a box-shaped mounting member 66 (guide main body) long in forward and backward directions along the drive roller 44 is arranged above the drive roller 44. This mounting member 66 constitutes a part of the frame 43. The lower surface of the mounting member 66 serves as a belt guiding surface 67 (see FIG. 4), and the left surface thereof serves as a sheet guiding surface 68 (guiding surface).

The belt guiding surface 67 is opposed to the top surface of the intermediate transfer belt 41 with a clearance defined therebetween for guiding the conveyance of the intermediate transfer belt 41. On the other hand, the sheet guiding surface 68 is inclined to slightly obliquely extend from a position slightly to the left of a position right above the center of the drive roller 44 toward an upper left. As shown in FIG. 6, a multitude of ribs 69 extending substantially in vertical direction project from the sheet guiding surface 68 while being spaced apart in forward and backward directions. The sheet guiding surface 68 guides the sheet P immediately after the toner images of the four colors are secondarily transferred to the top surface of the sheet P in the above secondary transfer nip portion T2. The guide roller units 1 according to this embodiment are mounted on the sheet guiding surface 68. In other words, the sheet guiding surface 68 is a mount portion for the guide roller units 1.

(Guide Roller Unit)

As shown in FIGS. 3 to 5, in this embodiment, a plurality of guide roller units 1, e.g., four guide roller units, are allocated at front and back sides with respect to the center of the mounting member 66 in forward and backward directions, i.e. two guide roller units 1 are arranged at the front side and two are arranged at the back side. FIGS. 6 to 9 show one of these guide roller units 1.

The guide roller unit 1 includes a holder 70 and a guide roller 80 rotatably supported in this holder 70. The holder 70 is formed by bending a flat piece of a steel plate (spring steel) having a specified shape. Here, the specified shape means that the three-dimensional holder 70 as shown in FIGS. 6 to 9 can be formed by bending the steel plate having this shape. The holder 70 includes a base part 71, a pair of bearing parts 72 and widening preventing plates 73.

The base part 71 has a substantially rectangular shape. The base part 71 includes an upper hook 71*a* formed by bending an upper end thereof to the right and then downward. This upper hook 71*a* is engaged with an upper end edge 68*a* of the sheet guiding surface 68 of the mounting member 66. On the other hand, the base part 71 includes a lower hook 71*b* formed by bending a lower end thereof to the right and then upward. This lower hook 71*b* is engaged with a lower end edge 68*b* of the sheet guiding surface 68 of the mounting member 66. Thus, in this embodiment, the base part 71 can be mounted in close contact with the sheet guiding surface 68 without particularly requiring screws or the like by engaging the upper and lower hooks 71*a*, 71*b* with the sheet guiding surface 68.

A pair of bearing parts 72 are formed by bending a front end and a rear end of the base part 71. The pair of bearing parts 72 are bent along bending lines L1, L2 (first bending portions) extending in vertical direction to stand substantially at right angles to the base part 71. A through hole 72*a* for rotatably supporting the guide roller 80 to be described later is so formed to penetrate each bearing part 71 at a left end. An arcuate portion 72*b* centered on the through hole 72*a* is formed at the left end of each bearing part 72.

As shown in FIG. 9, tooth portions 84*a* on the outer circumferential surface of the guide roller 80 project outward from the arcuate portion 72*b*. Parts continuous with the arcuate portions 72*b* at the left ends of the bearing parts 72 are formed into inclined portions 72*c* inclined downward to the right. The inclined portions 72*c* are for guiding the leading end of the sheet P immediately after the toner image is secondarily transferred in the secondary transfer nip portion T2 as shown in FIG. 2. The widening preventing plates 73 are provided at the upper ends of the pair of respective bearing parts 72.

Out of a pair of widening preventing parts 73, the front one 73 is formed by bending an upper end thereof along a bending line L3 (second bending portion) extending in transverse direction at right angles to extend forward (toward the front). The back widening preventing part 73 is formed by bending an upper end thereof along a bending line L4 (second bending portion) extending in transverse direction at right angles to extend backward (toward the back). In other words, the pair of front and back widening preventing parts 73 are so provided on the respective bearing parts 72 as to extend in directions opposite to the facing directions of the pair of bearing parts 72.

In this embodiment, the front and back widening preventing parts 73 are formed to be substantially at right angles to the base part 71. The widening preventing parts 73 are arranged downstream of small-diameter portions (rotary shaft) of the guide roller 80 in a conveying direction of the sheet P. By arranging the widening preventing parts 72 at such positions, the leading end of the sheet P can be made less likely to get caught as compared to the case where the widening preventing parts 73 are arranged upstream of the small-diameter portions.

Left ends 73L of the widening preventing parts 73 are located substantially at the same position as the through holes 72 of the bearing parts 72 as shown in FIG. 9. Thus, the widening of the pair of bearing parts 72 can be effectively prevented when such a force as to widen the leading ends of the bearing parts 72 with respect to the base ends thereof connected with the base part 71.

A projection 73*b* projecting outward (rightward) is provided at the right end of each widening preventing part 73. In this embodiment, the projections 73*b* are provided at positions of the widening preventing parts 73 most distant from the bending lines L3, L4. This is to bring the widening preventing parts 73 into contact with the sheet guiding surface 68 when the sheet guiding surface 68 is uneven by having the ribs 69 and the like as shown in FIG. 8 while circumventing these ribs 69 and the like. Accordingly, if the sheet guiding surface 68 is flat, it is not particularly necessary to provide such projections 73*b* and the entire right ends of the widening preventing parts 73 can be formed straight. For example, if the unevenness of the sheet guiding surface 68 is the one (not shown) different from that shown in FIG. 6, the shape of the right ends of the widening preventing parts 73 can be suitably determined so as to avoid such unevenness.

Here, in this embodiment, the underside of the base part 71 and the leading ends (right ends) of the projections 73*b* are aligned in the positional relationship shown in FIG. 8. Further, protuberances (not shown: e.g. about 0.3 mm) are provided at the leading ends (right ends) of the projections 73*b*. Thus, the guiding roller 80 is reliably prevented from coming off as described later by causing such forces as to bias the pair of bearing parts 72 slightly inward when the guiding roller unit 1 is mounted on the sheet guiding surface 68.

The guiding roller 80 includes a large-diameter portion 81 located between the above pair of bearing parts 72, the small-diameter portions (rotary shaft) 82 formed at the opposite longitudinal ends, spherical portions 83 projecting outward from the small-diameter portions 82 and a spur portion 84 disposed in the center of the large-diameter portion 81. The guiding roller 80 is entirely formed of, e.g. a synthetic resin, so that the large-diameter portion 81, the small-diameter portions 82, the spherical portions 83 and the spur portion 84 are integral to each other.

The diameter of the large-diameter portion 81 is set larger than that of the through holes 72*a* of the above bearing parts 72, and the length thereof is set slightly shorter than a distance between the above pair of bearing parts 72. The diameter of the small-diameter portions 82 is set slightly shorter than that of the through holes 72*a* of the bearing parts 72, so that the guiding roller 80 can smoothly rotate when the small-diameter portions 82 are engaged with the through holes 72*a*.

The spherical portions 83 have a substantially semispherical shape and have a diameter slightly smaller than that of the small-diameter portions 82. The spherical portions 83 act to guide the small-diameter portions 82 to the through holes 72*a* when the small-diameter portions 82 are engaged with the through holes 72*a* upon assembling the guiding roller 80 into the holder 70 as described later.

The spur portion 84 is disposed in the longitudinal center of the large-diameter portion 81 and has a multitude of tooth portions 84*a* formed on the outer circumference thereof. As shown in FIG. 9, the guiding roller 80 is supported by the bearing parts 72 in such a positional relationship that the leading ends of the tooth portions 84*a* project from the arcuate portions 72*b* at the left ends of the bearing parts 72. The projecting leading ends of the tooth portions 84*a* come into contact with the surface of the sheet P being conveyed to guide the sheet P.

The guiding roller unit 1 constructed as above has the guiding roller 80 assembled into the holder 70 as described below and, thereafter, is mounted on the sheet guiding surface 68 of the mounting member 66 of the intermediate transfer belt unit 3.

A user applies such forces to the holder 70 as to widen the leading ends of the pair of bearing parts 72 outward. At this time, the widening preventing parts 73 of the holder 70 are not brought into contact with the sheet guiding surface 68 unlike after the guiding roller unit 1 is mounted on the sheet guiding surface 68. Thus, the user can relatively easily widen the bearing parts 72 with respect to the base ends thereof connected with the base part 71.

In this state, the user places the guiding roller 80 between the pair of bearing parts 72 from the widened side, and inserts the spherical portions 83 at the opposite ends into the through holes 72*a* of the bearing parts 72 from the inner sides to engage the small-diameter portions 82 with the through holes 72*a*. At this time, the small-diameter portions 82 can be easily engaged since the spherical portions 83 act as the guides. Upon such engagement, the widened bearing parts 72 are restored to their original shapes due to their own elasticity. In this way, the guiding roller unit 1 is completed.

Subsequently, a case where this guiding roller unit 1 is mounted on the sheet guiding surface 68 is described. The user presses the base part 71 of the holder 70 at a mount position on the sheet guiding surface 68 and presses the leading ends of the projections 73*b* of the widening preventing parts 73 against the sheet guiding surface 68. Then, the user hooks the upper and lower hooks 71*a*, 71*b* into engagement with the upper and lower edges 68*a*, 68*b* of the sheet guiding surface 68. In this way, the mounting of the guiding roller unit 1 on the sheet guiding surface 68 is completed.

In this state, the pair of bearing parts 72 are biased to inline slightly inward by the protuberances at the leading ends of the projections 73*b* of the widening preventing parts 73 as described above. Since the leading ends of the tooth portions 84*a* of the spur portion 84 of the guiding roller 80 project from the arcuate portions 72*b* of the bearing parts 72 in this state, the sheet P can be guided.

The spacing between the bearing parts 72 is not widened after the guiding roller unit 1 is mounted on the sheet guiding surface 68 even if forces act to widen the leading ends of the bearing parts 72, for example, when a jammed sheet P gets caught upon being removed. In other words, even if the widening forces act, the widening preventing parts 73 press the sheet guiding surface 68 to prevent the widening of the bearing parts 72, wherefore it can be prevented that the bearing parts 72 are unnecessarily deformed and the guiding roller 80 comes off the bearing parts 72.

Further, since the holder 70 has a single body construction or an integral construction including the widening preventing parts 73, i.e. since the base part 71, the pair of bearing parts 72 and the widening preventing parts 73 constituting the holder 70 are integrally formed as a single member, the number of parts can be reduced and the number of assembling steps can be reduced.

Figure 10:
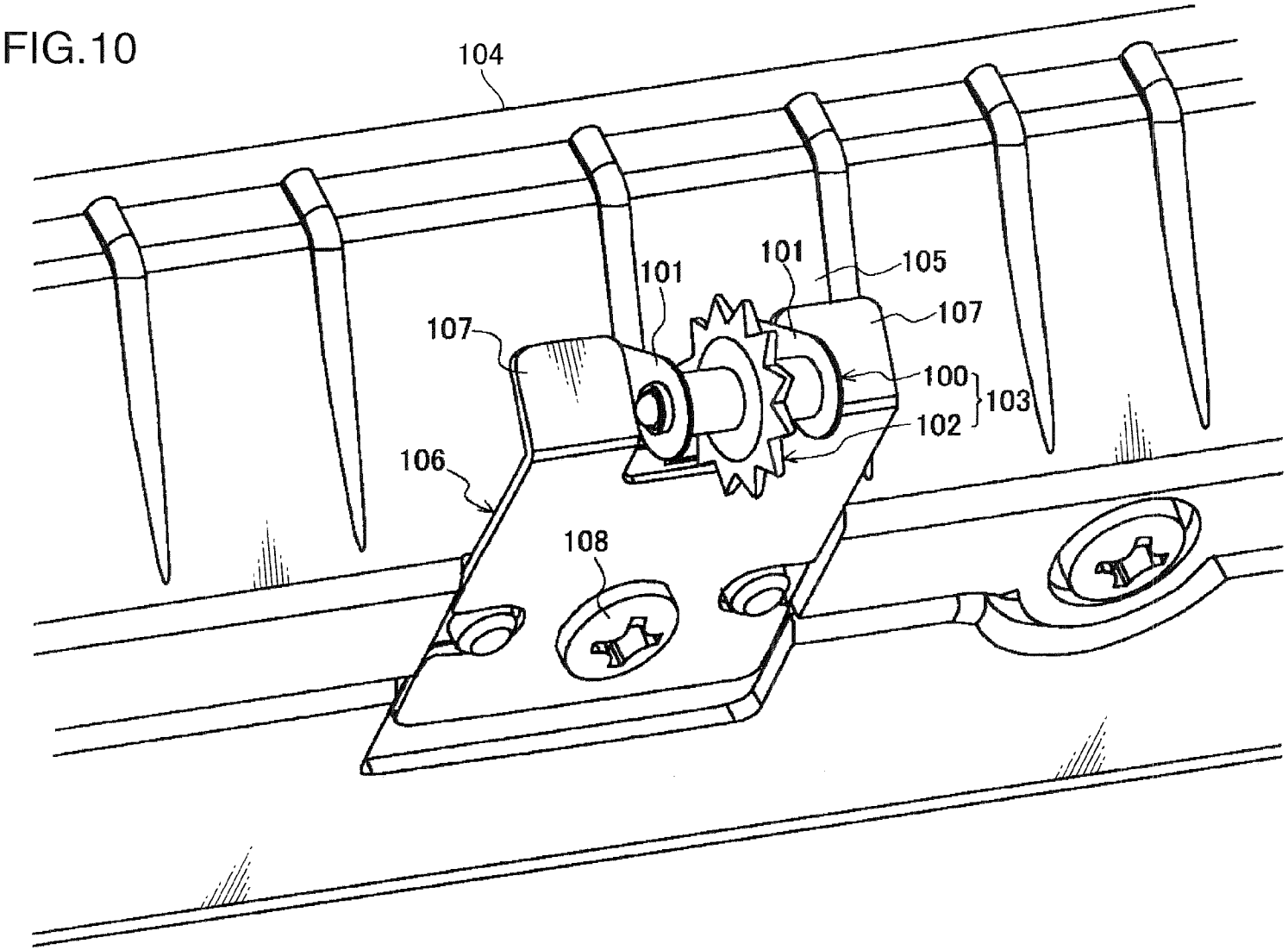
FIG. 10 is a perspective view enlargedly showing a mounted state of a guide roller unit according to a contrast technology of the invention.

Here, it can be thought to separately mount a holder 100 and a widening preventing part 106 as shown in FIG. 10 on a mount portion 105 in place of the above guiding roller unit 1. The holder 100 is formed into a U-shape by having a pair of bearing parts 101 and a base part (not shown) connecting the base ends of the bearing parts 101. In a guiding roller unit 103, a guiding roller 102 is rotatably supported by the pair of bearing parts 101. The widening preventing part 106 includes a pair of restricting plates 107 for restricting the pair of bearing parts 101 from the outsides. The restricting plates 107 are so arranged as to lightly touch or to be proximate to the outside surfaces of the bearing parts 101, and prohibit the widening of the bearing parts 101 if forces act on the bearing parts 101 in such directions as to widen the spacing between the bearing parts 101. The widening preventing part 106 is mounted on a mounting member 104 by screws 108.

However, the construction shown in FIG. 10 has problems of increasing the number of parts and the number of assembling steps. In other words, the widening preventing part 106 as a separate member, the screws 108 for fixing the widening preventing part 106 and the like are added, and the operation step of mounting this widening preventing part 106 is added.

On the contrary, the above guiding roller unit 1 is a single member, requires no mounting members such as screws and can reduce the number of parts and the number of assembling steps.

The embodiment of the present invention is described above. However, the scope of the present invention is not limited to the above and various changes can be made without departing from the gist of the present invention. For example, modifications (1) to (7) below can be adopted.

(1) Although the widening preventing parts 73 are bent at right angles (90°) to the bearing parts 72 in the above embodiment, the angles thereof are not limited to right angles. For example, it is also possible to set the widening preventing parts 73 at 45°, 60° or other angles to the bearing parts 72. If the widening preventing parts 73 interfere with the unevenness of the sheet guiding surface 68 of the mounting member 66, for example, in the case where the widening preventing parts 73 are bent at 90°, it is also possible to set the widening preventing parts 73 at such angles as not to interfere with the unevenness. However, in light of preventing the widening, 90° or angles close to 90° are most preferable.

(2) In the above embodiment, the holder 70 is formed by bending the single flat piece of steel plate having a specified shape. Instead, the entire holder 70 may be integrally formed of a synthetic resin. This is particularly effective in the case where a steel plate cannot be utilized for the electrical reason. In this case as well, the same effects as in the case where the holder is made of the steel plate can be fulfilled in light of preventing the widening.

(3) In the above embodiment, the guiding roller units 1 are arranged immediately downstream of the secondary transfer nip portion T2. Instead, they may be arranged immediately downstream of the fixing nip portion N.

(4) In the above embodiment, the guiding roller 80 is in the form of a spur. Instead, a roller having an ordinary shape such as a cylindrical shape may be used.

(5) In the above embodiment, the upper and lower hooks 71*a*, 71*b* of the holder 70 are engaged with the sheet guiding surface 68 upon mounting the holder 70 on the sheet guiding surface 68. The mounting mode is not limited to this and, for example, the holder 70 may be mounted on the sheet guiding surface 68 by fastening members such as screws.

(6) In the above embodiment, the image forming apparatus using the guiding roller units 1 is described, taking the electrophotographic image forming apparatus as an example. The guiding roller units 1 can be also used, for example, in ink-jet image forming apparatuses without being restricted to the use in the above image forming apparatus. For example, the guiding roller units 1 can be arranged in a discharging device for discharging a sheet printed with ink to guide an ink-printed surface.

(7) Although the inventive guiding roller unit is used in the image forming apparatus such as a printer or a copier in the above description, such a unit can be applied to guiding devices in general for guiding the conveyance of sheets. In this case, guiding roller unit(s) is/are mounted on a guiding surface of a guide main body having the guiding surface for guiding a sheet.

The specific embodiment described above mainly embraces inventions having the following constructions.

A guiding roller unit according to one aspect of the present invention comprises a holder to be mounted on a specified mount portion; and a guiding roller including a rotary shaft rotatably supported by the holder, wherein the holder includes a base part to be mounted on the mount portion, a pair of bearing parts standing from one end and the other end of the base part to face each other and engaged with the opposite ends of the rotary shaft of the guiding roller from outsides to rotatably support the guide roller, and widening preventing parts attached to the pair of bearing parts in such a manner as to extend in directions opposite to facing directions of the respective bearing parts, the base part, the bearing parts and the widening preventing parts being integral to each other; the guide roller being able to be attached and detached while leading ends of the bearing parts are elastically widened with respect to base ends of the bearing parts connected with the base part when the holder is detached from the mount portion; and the widening of the leading ends of the bearing parts being prohibited by coming into contact with the mount portion in response to forces acting in widening directions when the holder is mounted on the mount portion.

According to this construction, since the widening preventing parts are attached to the pair of bearing parts in such a manner as to extend in the directions opposite to the facing directions of the respective bearing parts, the widening of the leading ends of the bearing parts is not hindered upon mounting the guide roller on the bearing parts. Accordingly, the guiding roller can be easily mounted on the bearing parts. On the other hand, in the state of the holder mounted on the mount portion, the parts of the widening preventing parts come into contact with the mount portion to prohibit the widening of the leading ends of the bearing parts in response to the forces acting in the widening directions. Thus, there is no likelihood that the guiding roller comes off the holder. Further, since the base part, the bearing parts and the widening preventing parts are integrally formed, the number of parts can be reduced and the number of assembling steps can be reduced.

In the above construction, the widening preventing parts may be preferably arranged downstream of an arrangement position of the rotary shaft of the guiding roller in a conveying direction of a sheet.

According to this construction, the sheet being guided by the guiding roller is unlikely to get caught by the widening preventing parts as compared to the case where the widening preventing parts are arranged downstream of the arrangement position in the conveying direction of the sheet.

In the above construction, it may be preferable that the bearing parts stand substantially at right angels to the base part and that the widening preventing parts extend substantially at right angles to the bearing parts and the base part.

According to this construction, the holder has such a simple structure that any of the base part, the bearing parts and the widening preventing parts is/are substantially at right angles to the other two (e.g. the bearing parts and the widening preventing parts relative to the base part) and, if external forces try to widen the spacing between the leading ends of the bearing parts after the holder is mounted on the mount portion, this can be efficiently prevented. Here, the inclusive angle may be preferably a right angle, but may not necessarily be a right angle depending on variations in processing accuracy and assembling accuracy.

In the above construction, the guide roller may be preferably in the form of a spur. According to this construction, even if the guide roller is in contact with, for example, a toner image transferred to a sheet, a toner image fixed to a sheet, an image formed with ink on a sheet or the like, it does not largely distort these images.

In the above construction, it may be preferable that the holder is a bent body of a metallic material and that the bent body includes first bending portions located at boundaries between the base part and the bearing parts, and second bending portions located at boundaries between the bearing parts and the widening preventing parts.

According to this construction, the base part, the bearing parts and the widening preventing parts of the holder can be easily produced by bending a single flat piece of a steel plate having a specified shape.

In the above construction, the holder may be a molded body of a synthetic resin. According to this construction, the base part, the bearing parts and the widening preventing parts of the holder can be easily integrally molded of the synthetic resin.

In the above construction, it may be preferable that the base part has a substantially rectangular shape; that the bearing parts stand from first and second sides of the rectangular base part facing each other; and hooks used to mount the base part on the mount portion are provided at third and fourth sides of the base part orthogonal to the first and second sides and facing each other.

According to this construction, the base part can be mounted on the mount portion without particularly requiring screws.

In the above construction, it may be preferable that the bearing parts are formed with through holes through which the rotary shaft of the guiding roller is inserted; and that sides of the widening preventing parts located at one ends of the second bending portions extend up to the vicinities of the formation positions of the through holes.

According to this construction, the widening of the spacing between the pair of bearing parts can be effectively prevented when such forces act to widen the leading ends of the bearing parts with respect to the base ends thereof connected with the base part.

In the above construction, it may be preferable that each widening preventing part includes a projection to be held in contact with the mount portion with the holder mounted on the mount portion; and that the projections exert such forces to bias the pair of bearing parts slightly inward in the mounted state of the holder.

According to this construction, the guiding roller can be reliably prevented from coming off.

A sheet Guiding device according to another aspect of the present invention comprises a guide main body having a guiding surface for guiding a sheet; and a guiding roller unit mounted on the guiding surface, the guiding roller unit including a holder mounted on the guiding surface, and a guiding roller including a rotary shaft and rotatably supported by the holder, wherein the holder includes a base part to be mounted on the guiding surface, a pair of bearing parts standing from one end and the other end of the base part to face each other and engaged with the opposite ends of the rotary shaft of the guiding roller from outsides to rotatably support the guide roller, and widening preventing parts attached to the pair of bearing parts in such a manner as to extend in directions opposite to facing directions of the respective bearing parts, the base part, the bearing parts and the widening preventing parts being integral to each other; the guide roller being able to be attached and detached while leading ends of the bearing parts are elastically widened with respect to base ends of the bearing parts connected with the base part when the holder is detached from the guiding surface; and the widening of the leading ends of the bearing parts being prohibited by coming into contact with the guiding surface in response to forces acting in widening directions when the holder is mounted on the guiding surface.

In this case, a plurality of guiding roller units may be preferably arranged on the guiding surface.

An image forming apparatus according to still another aspect of the present invention comprises a sheet storing section for storing sheets; an image forming assembly for forming an image on a sheet; a sheet conveyance path for conveying the sheet via the image forming assembly; and a guiding roller unit arranged in the sheet conveyance path downstream of the image forming assembly for guiding the sheet, the guiding roller unit including a holder mounted on a specified mount portion, and a guiding roller including a rotary shaft rotatably supported by the holder, wherein the holder includes a base part mounted on the mount portion, a pair of bearing parts standing from one end and the other end of the base part to face each other and engaged with the opposite ends of the rotary shaft of the guiding roller from outsides to rotatably support the guide roller, and widening preventing parts attached to the pair of bearing parts in such a manner as to extend in directions opposite to facing directions of the respective bearing parts, the base part, the bearing parts and the widening preventing parts being integral to each other; the guide roller being able to be attached and detached while leading ends of the bearing parts are elastically widened with respect to base ends of the bearing parts connected with the base part when the holder is detached from the mount portion; and the widening of the leading ends of the bearing parts being prohibited by coming into contact with the mount portion in response to forces acting in widening directions when the holder is mounted on the mount portion.

In the above construction, it may be preferable that a mounting member having a guiding surface for guiding the sheet is further provided; and that the guiding roller unit is mounted on the guiding surface.

In this case, it may be preferable that the image forming assembly includes an intermediate transfer belt for primarily transferring a toner image and a secondary transfer device for transferring the toner image formed on the intermediate transfer belt to the sheet; and that the guiding surface is arranged downstream of and in proximity to the secondary transfer device in a sheet conveyance direction.

The mounting member may be preferably further provided with a belt guiding surface for guiding the intermediate transfer belt.

This application is based on patent application No. 2007-041991 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A guiding roller unit, comprising:

a holder to be mounted on a specified mount portion; and a guiding roller including a rotary shaft and rotatably supported by the holder, wherein:

the holder includes:

a base part to be mounted on the mount portion, a pair of bearing parts standing from one end and the other end of the base part to face each other and engaged with opposite ends of the rotary shaft of the guiding roller from outsides to rotatably support the guide roller, and widening preventing parts attached to the pair of bearing parts in such a manner as to extend in directions opposite to facing directions of the respective bearing parts, wherein each of the widening preventing parts has a contact portion that is disposed for directly contacting the mount portion, the base part, the bearing parts and the widening preventing parts being integral to each other, the guide roller being able to be attached and detached to the bearing parts while leading ends of the bearing parts are elastically widened with respect to base ends of the bearing parts connected with the base part when the holder is detached from the mount portion, and the widening of the leading ends of the bearing parts being prohibited by direct contact between the contact portions of the widening preventing parts and the mount portion when the holder is mounted on the mount portion.

2. A guiding roller unit according to claim 1, wherein the widening preventing parts are arranged downstream of an arrangement position of the rotary shaft of the guiding roller in a conveying direction of a sheet.

3. A guiding roller unit according to claim 1, wherein:

the bearing parts stand substantially at right angels to the base part; and the widening preventing parts extend substantially at right angles to the bearing parts and the base part.

4. A guiding roller unit according to claim 1, wherein the guide roller is in the form of a spur.

5. A guiding roller unit according to claim 1, wherein:

the holder is a bent body of a metallic material; and the bent body includes first bending portions located at boundaries between the base part and the bearing parts and second bending portions located at boundaries between the bearing parts and the widening preventing parts.

6. A guiding roller unit according to claim 1, wherein the holder is a molded body of a synthetic resin.

7. A guiding roller unit according to claim 1, wherein:

the base part has a substantially rectangular shape;

the bearing parts stand from first and second sides of the rectangular base part facing each other; and the base part includes third and fourth sides orthogonal to the first and second sides and facing each other, the third and fourth sides being provided with hooks used to mount the base part on the mount portion.

8. A guiding roller unit according to claim 5, wherein:

the bearing parts are formed with through holes through which the rotary shaft of the guiding roller is inserted; and sides of the widening preventing parts located at one ends of the second bending portions extend up to the vicinities of the formation positions of the through holes.

9. A guiding roller unit according to claim 1, wherein:

the contact portion of each widening preventing part is a projection to be held in contact with the mount portion with the holder mounted on the mount portion; and the projections exert such forces to bias the pair of bearing parts slightly inward in the mounted state of the holder.

10. A guiding device for guiding a sheet being conveyed, comprising:

a guide main body having a guiding surface for guiding a sheet; and a guiding roller unit mounted on the guiding surface, the guiding roller unit including a holder mounted on the guiding surface, and a guiding roller having a rotary shaft rotatably supported by the holder, wherein:

the holder includes:

a base part mounted on the guiding surface, a pair of bearing parts standing from one end and the other end of the base part to face each other and engaged with opposite ends of the rotary shaft of the guiding roller from outsides to rotatably support the guide roller, and widening preventing parts attached to the pair of bearing parts in such a manner as to extend in directions opposite to facing directions of the respective bearing parts, each of the widening preventing parts having a contact portion that is disposed for contacting the guide main body, the bearing parts and the widening preventing parts being integral to each other;

the guide roller being able to be attached and detached while leading ends of the bearing parts are elastically widened with respect to base ends of the bearing parts connected with the base part when the holder is detached from the guiding surface, and the widening of the leading ends of the bearing parts being prohibited by direct contact between the contact portions of the widening preventing parts and the guide main body when the holder is mounted on the guiding surface.

11. A guiding device according to claim 10, wherein a plurality of guiding roller units are arranged on the guiding surface.

12. A guiding device according to claim 10, wherein the widening preventing parts are arranged downstream of an arrangement position of the rotary shaft of the guiding roller in a conveying direction of a sheet.

13. A guiding device according to claim 10, wherein:

the bearing parts stand substantially at right angels to the base part; and the widening preventing parts extend substantially at right angles to the bearing parts and the base part.

14. A guiding device according to claim 10, wherein the guide roller is in the form of a spur.

15. A guiding device according to claim 10, wherein:

the holder is a bent body of a metallic material; and the bent body includes first bending portions located at boundaries between the base part and the bearing parts and second bending portions located at boundaries between the bearing parts and the widening preventing parts.

16. A guiding device according to claim 10, wherein the holder is a molded body of a synthetic resin.

17. An image forming apparatus, comprising:

a sheet storing section for storing sheets;

an image forming assembly for forming an image on a sheet;

a sheet conveyance path for conveying the sheet via the image forming assembly; and a guiding roller unit arranged in the sheet conveyance path downstream of the image forming assembly for guiding the sheet, the guiding roller unit including a holder mounted on a specified mount portion, and a guiding roller including a rotary shaft rotatably supported by the holder, wherein:

the holder includes:

a base part mounted on the mount portion, a pair of bearing parts standing from one end and the other end of the base part to face each other and engaged with opposite ends of the rotary shaft of the guiding roller from outsides to rotatably support the guide roller, and widening preventing parts attached to the pair of bearing parts in such a manner as to extend in directions opposite to facing directions of the respective bearing parts, wherein each of the widening preventing parts has a contact portion that is disposed for directly contacting the mount portion, the base part, the bearing parts and the widening preventing parts being integral to each other;

the guide roller being able to be attached and detached while leading ends of the bearing parts are elastically widened with respect to base ends of the bearing parts connected with the base part when the holder is detached from the mount portion, and the widening of the leading ends of the bearing parts being prohibited by direct contact between the contact portions of the widening preventing parts and the mount portion when the holder is mounted on the mount portion.

18. An image forming apparatus according to claim 17, further comprising a mounting member having a guiding surface for guiding the sheet, wherein the guiding roller unit is mounted on the guiding surface.

19. An image forming apparatus according to claim 18, wherein:

the image forming assembly includes an intermediate transfer belt for primarily transferring a toner image and a secondary transfer device for transferring the toner image formed on the intermediate transfer belt to the sheet; and the guiding surface is arranged downstream of and in proximity to the secondary transfer device in a sheet conveyance direction.

20. An image forming apparatus according to claim 19, wherein the mounting member further includes a belt guiding surface for guiding the intermediate transfer belt.

* * * * *